US006519779B1

(12) United States Patent
Taguchi

(10) Patent No.: US 6,519,779 B1
(45) Date of Patent: Feb. 18, 2003

(54) APPAREL WITH INTERCHANGEABLE INDICIA

(75) Inventor: Jon Taguchi, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/893,360

(22) Filed: Jun. 26, 2001

(51) Int. Cl.[7] ..... A42B 1/00
(52) U.S. Cl. ..... 2/209.12; 2/195.1
(58) Field of Search ..... 2/410, 246, 115, 2/195.1–195.4, 209.11, 171, 171.1, 171.3, 171.4, 171.5, 171.8, 172, 181, 181.6, 182.8, 183, 209.12, 209.13, 209.14, 209.3, 209.4, 209.5, 175.1, 175.7, 195.7, 908, 918, DIG. 11, 69; 24/3.1, 306, 113 R, 113 NP, 114.9, 163 K, 442; 40/1.5, 594, 329, 633, 640, 586

(56) References Cited

U.S. PATENT DOCUMENTS

| | | | | | |
|---|---|---|---|---|---|
| 2,527,258 | A | | 10/1950 | Kahn | |
| 3,077,690 | A | | 2/1963 | Feldman | |
| 3,484,974 | A | * | 12/1969 | Culmone | 2/115 |
| 4,052,773 | A | * | 10/1977 | Nesbitt | 24/163 K |
| 4,354,282 | A | | 10/1982 | Langdon | |
| 4,480,399 | A | * | 11/1984 | Teti, Jr. | 40/584 |
| 4,611,355 | A | * | 9/1986 | Galanto et al. | 2/209.13 |
| 4,621,441 | A | * | 11/1986 | Wagner et al. | 36/1 |
| 4,667,274 | A | | 5/1987 | Daniel | |
| 4,697,362 | A | * | 10/1987 | Wasserman | 36/136 |
| 4,776,043 | A | | 10/1988 | Coleman | |
| 5,016,373 | A | | 5/1991 | Theno | |
| 5,052,056 | A | | 10/1991 | Braun | |
| 5,136,726 | A | | 8/1992 | Kellin et al. | |
| 5,147,129 | A | | 9/1992 | Ku | |
| 5,253,368 | A | | 10/1993 | Blake | |
| 5,359,733 | A | | 11/1994 | Brannon et al. | |
| 5,359,734 | A | | 11/1994 | Rathburn | |
| 5,477,629 | A | | 12/1995 | Gleason, Jr. | |
| 5,845,334 | A | | 12/1998 | Marcolini, Jr. | |
| 5,862,523 | A | * | 1/1999 | Proctor | 2/171 |
| 5,953,757 | A | | 9/1999 | Blanks | |
| 6,170,087 | B1 | * | 1/2001 | Brannon | 2/209.13 |
| 6,175,963 | B1 | * | 1/2001 | Loeffelholz | 2/200.1 |
| 6,182,388 | B1 | * | 2/2001 | Patton | 24/163 K |

* cited by examiner

*Primary Examiner*—Gary L Welch
(74) *Attorney, Agent, or Firm*—Banner & Witcoff, Ltd.

(57) ABSTRACT

This invention is directed to an article of apparel, more particularly to a customizable baseball-style cap, wherein removable portions having indicia displayed thereon may be replaced by alternate portions displaying an alternate form of indicia. The indicia may include one or more words, names, numbers, designs, logos, symbols, colors, or patterns.

44 Claims, 4 Drawing Sheets

APPAREL WITH INTERCHANGEABLE INDICIA

BACKGROUND OF THE INVENTION

1. Field of the Invention

This invention relates to an article of apparel, such as a baseball-style cap, that includes interchangeable panels, thereby permitting the wearer to customize the article of apparel.

2. Description of Background Art

The standard baseball cap includes a crown and visor. The crown is typically configured from multiple panels that are sewn together to form a closely-fitting covering for the wearer's head. The visor extends horizontally from the front of the crown and serves to shade the wearer's face and eyes. A wide range of materials, natural or synthetic, may be used to form a baseball cap.

The baseball cap was originally designed to prevent sunlight and rain from obscuring the vision of a baseball player. Like other specialized athletic equipment, the original baseball cap was used exclusively in the course of competition. For aesthetic purposes, the baseball cap included indicia and a color scheme consistent with that of the team's uniform. As the popularity of baseball grew, non-athletes began wearing baseball caps to publicly display their support for a particular team.

Today, baseball caps continue to be used by baseball players for purposes of competition, but the popularity of the baseball cap has grown beyond baseball and the notion of identifying with a particular baseball team. Modern baseball caps often display the indicia of athletic teams from sports other than baseball. In addition, baseball caps may contain the indicia of corporations, places, philosophies, or individual people such as entertainers or athletes.

Although indicia may be located anywhere on the baseball cap, the most common area is the brow region. Indicia may take a variety of forms, including patches, embroidery, or screen-printing, but one common characteristic is the permanent nature of the indicia. As such, an individual is required to purchase numerous baseball caps in order to display support for multiple athletic teams. Coupled with the possibility that the same individual may also wish to communicate an affinity for a particular brand or a philosophy, the permanent indicia may lead to a large baseball cap collection.

In an attempt to reduce the number of baseball caps that an individual need own to display multiple indicia, systems have been developed that employ removable or interchangeable panels, each panel having alternate indicia affixed thereto. To permit attachment and removal of the multiple indicia, these systems employ a non-permanent fastener to attach the panel to the baseball-style cap. Typically, the non-permanent fastener is a hook and loop attachment means. Patents employing removable or interchangeable panels include U.S. Pat. No. 4,776,043 to Coleman, U.S. Pat. No. 5,136,726 to Kellin et al., U.S. Pat. No. 5,359,733 to Brannon et al., U.S. Pat. No. 5,477,629 to Gleason, Jr., and U.S. Pat. No. 5,953,757 to Blanks, I.

U.S. Pat. No. 5,359,734 to Rathburn discloses a baseball cap with an opening in a vertical wall of the baseball cap. A first part of a hook and loop fastening system fills the opening and extends behind the opening where it is connected to the baseball cap. Multiple indicia having a surface comprised of the second part of the fastening system may then be removably-attached.

U.S. Pat. No. 5,845,334 to Marcolini, Jr. discloses articles, including hats, bags, and coats, that include a recess formed from the material that comprises the article. A first portion of a hook and loop fastening system is located within the recess. A patch containing indicia on one surface and a second portion of the fastening system on an opposite surface may then be removably-attached such that the surface containing the indicia is visible.

BRIEF SUMMARY OF THE INVENTION

The present invention relates to an article of apparel comprising a primary portion, a secondary portion, and a fastening system. The primary portion is configured to define an aperture. The secondary portion has dimensions approximately corresponding to the dimensions of the aperture and includes a fastening side and a display side located opposite to the fastening side. The fastening system releasably-attaches the secondary portion to the primary portion and includes a first fastening part and a second fastening part. The first fastening part is secured to and located entirely within the aperture and the second fastening part is attached to the fastening side of the secondary portion. Preferably, the article of apparel is headwear, such as a baseball cap. However, the customization system of the present invention may be utilized on any type of apparel.

The display side of the secondary portion includes one or more words, names, numbers, designs, logos, symbols, colors, patterns, or any other suitable indicia. Because the secondary portion is removable, it may be replaced with an alternate secondary portion with differing indicia. As such, a wearer may possess multiple secondary portions for use with a single primary portion. Alternatively, a single primary portion may include more than one aperture, each aperture receiving a different secondary portion. As such, multiple secondary portions may be moved between apertures or removed and replaced with alternate secondary portions.

A fastening system secures the secondary portion within the aperture. Preferably, the fastening system is a hook and loop fastening system, but any fastening system permitting releasable-attachment is suitable. Alternate systems of attachment include snaps, buttons, pins, and magnets. As noted, the first part of the fastening system is located entirely within the aperture. To secure the first fastening part to the primary portion, a separate connecting element may be used. By attaching the first fastening part to the connecting element and attaching the connecting element to the primary portion, the first fastening part is effectively attached to the headwear and limited to a location within the aperture. In a first primary embodiment, the connecting element is a thin section of cloth or polymer material that attaches to the interior of the apparel and around the perimeter of the aperture, the first fastening part attaching to the connecting element. In a second primary embodiment, the connecting element is a semi-rigid member, preferably a polymer, with an indentation formed in the area corresponding to the aperture, the first fastening part secured within the indentation. The advantage of the latter configuration is that the depth of the indentation may be formed such that the display side of the secondary portion is flush with the exterior of the apparel.

Although the first fastening part of a hook and loop fastener may extend throughout the aperture, a sufficiently durable connection may be made between the secondary portion and the primary portion using a first fastening part of lesser area. Preferably, the first fastening part is located only in portions of the aperture adjacent to edges of the aperture.

As such, an interior region is created in central portions of the aperture that does not include portions of the first fastening part. In lieu of the first fastening part, the interior region may include permanently-attached interior indicia. When the secondary portion is attached to the primary portion, the interior region and its associated interior indicia are veiled from view by the secondary portion. However, if the primary portion is worn without a secondary portion attached within the aperture, then the interior indicia will be visible.

Various advantages and features of novelty which characterize the invention are pointed out with particularity in the claims. However, for a better understanding of the invention, its advantages, and objects obtained by its use, reference should be made to the drawings, and to the accompanying descriptive matter, in which there is illustrated and described preferred embodiments of the invention.

DETAILED DESCRIPTION OF THE INVENTION

Figure 1:
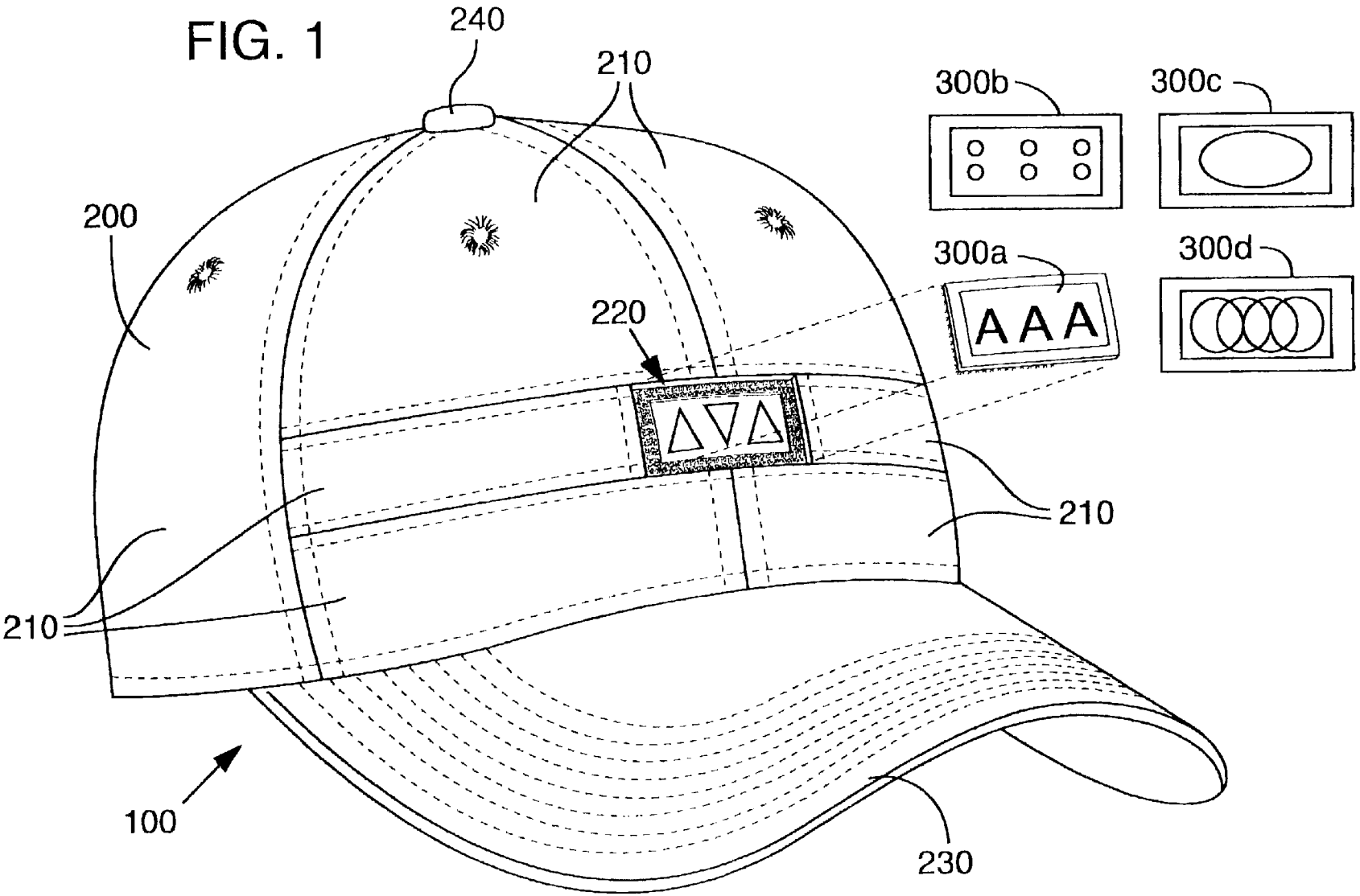
FIG. 1 depicts the article of apparel, in particular a baseball cap, of the present invention through a perspective view of the primary portion and a plurality of secondary portions.

Referring to the figures, wherein like numerals indicate like elements, an article of apparel in accordance with the present invention is depicted. Apparel 100, illustrated in FIG. 1, is comprised of primary portion 200, secondary portions 300*a*–300*d*, and a fastening system that releasably-attaches an individual secondary portion 300 to primary portion 200. As shown in FIG. 1, customization is achieved by removing a secondary portion 300, in this case secondary portion 300*a*, and interchanging the secondary portion 300 with an alternate secondary portion 300, in this case one of secondary portions 300*b*–300*d*. Although the customization system is depicted as being comprised of four secondary portions 300, use of four secondary portions 300 is for illustrative purposes only.

Primary portion 200 is comprised of panels 210, aperture 220, and visor 230. Panels 210 are a plurality of fabric sections that are joined to substantially form the concave structure that corresponds to the shape of the wearer's head. In the preferred embodiment, aperture 220 is formed by arranging panels 210 in a manner that defines an opening in the brow area of primary portion 200. In alternate embodiments, aperture 220 may be located in any area of primary portion 200, including an opening on the interior of an individual panel or an opening in visor 230. Furthermore, primary portion 200 may include multiple apertures, each aperture being configured to receive secondary portions 300. Visor 230 attaches to panels 210 in the lower brow area in a conventional manner and serves the purpose of shielding the wearer's eyes and face from sunlight or rain.

Figure 6:
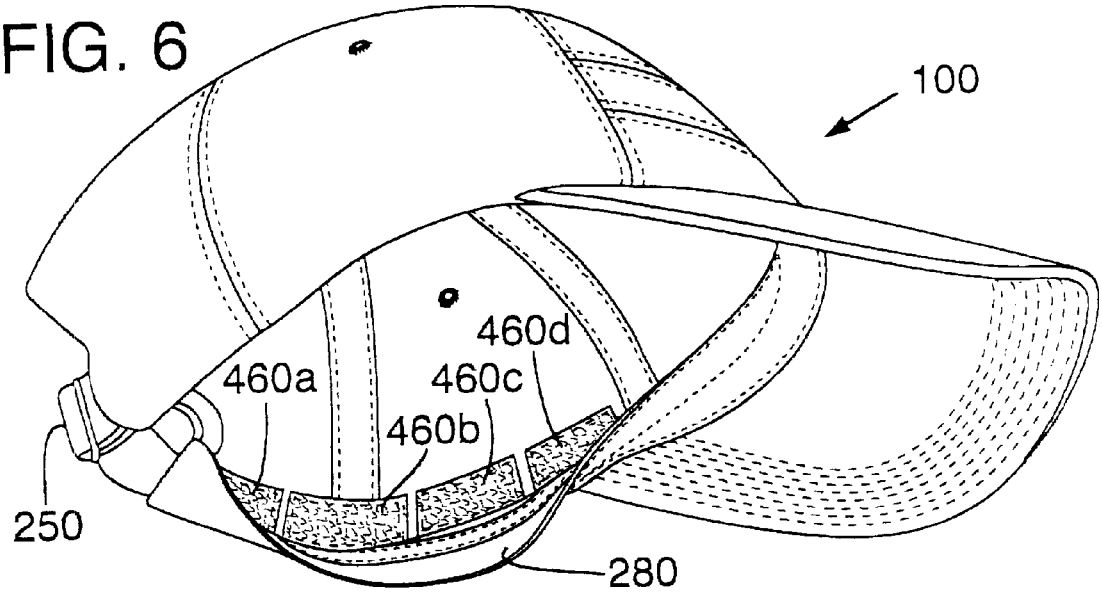
FIG. 6 is a perspective view of the interior of the baseball cap of FIG. 1 depicting the system for storing alternate secondary portions.

In addition to the above-mentioned elements, primary portion 200 may include miscellaneous components, including button 240 that serves the purpose of strengthening and covering the junction of panels 210, adjustment mechanism 250 that provides adjustable fit (see FIG. 6), and flap 280 for concealing secondary portions 300 that are attached to third fastening parts 460 (see FIG. 6).

Figure 2A:
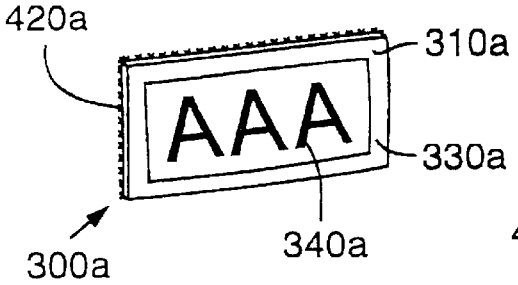
FIG. 2A is a perspective view of the front of a secondary portion.
Figure 2B:
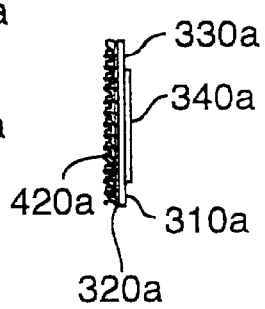
FIG. 2B is aside view of the secondary portion depicted in FIG. 2A.
Figure 2C:
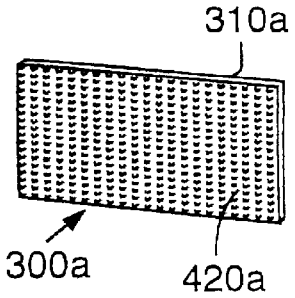
FIG. 2C is a perspective view of the back of the secondary portion depicted in FIG. 2A.

Secondary portion 300*a*, being formed of substrate 310*a* and indicia 340*a*, is depicted in FIGS. 2. Substrate 310*a* has two primary sides, fastening side 320*a* and an opposite display side 330*a*. Indicia 340*a* may be one or more words, names, numbers, designs, logos, symbols, colors, or patterns that are printed, embroidered, embossed, inscribed, engraved, or otherwise attached to display side 330*a*. The fastening system, described in detail below, includes a first fastening part 410 and a plurality of second fastening parts 420, each second fastening part 420 attached to a fastening side 320 of one of the secondary portions 300. The fastening system facilitates attachment of secondary portion 300*a* to primary portion 200 in aperture 220 such that indicia 340*a* faces outward. With regard to FIGS. 2, second fastening part 420*a* is attached to fastening surface 320*a*. Note that the design and construction of other secondary portions 300 is substantially similar, the fundamental difference being the style of indicia 340. Substrate 310*a* may be formed of any number of suitable materials, including rigid, semi-rigid, or flexible materials such as rubber, plastic, cloth, or fabric.

Figure 3:
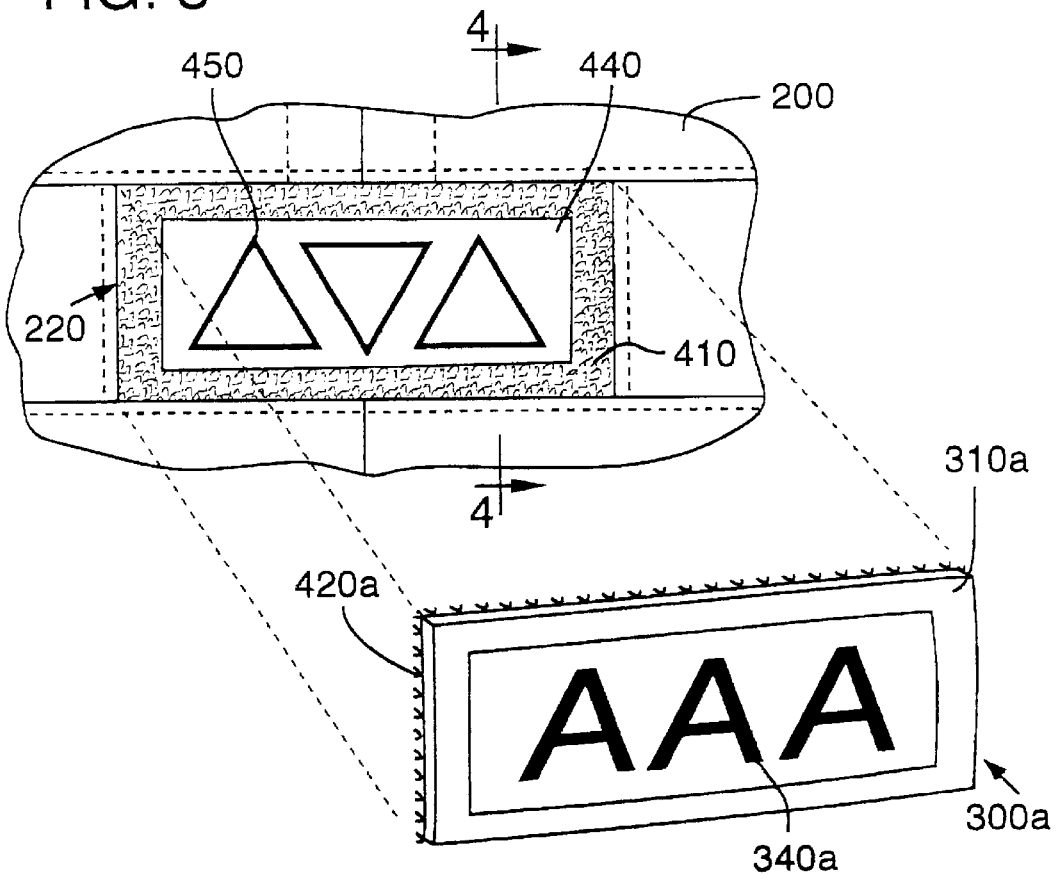
FIG. 3 is a detailed view of a portion of the baseball cap depicted in FIG. 1.

FIGS. 3 and 4 detail aperture 220 and first fastening part 410 secured therein. Although dimensions for this region are variable in practice, the preferred embodiment includes a rectangular aperture measuring approximately 4 centimeters in width and 2 centimeters in height. The exterior dimensions of first fastening part 410 are substantially identical to those of aperture 220. Located on the interior of primary portion 200, and securing first fastening part 410 in aperture 220, is connecting element 430, measuring approximately 5.5 centimeters in width and 3.5 centimeters in height.

With reference to FIG. 3, secondary portion 300*a* is depicted in a position that facilitates attachment with primary portion 200. Second fastening part 420*a* is attached to substrate 310*a* such that indicia 340*a* lies on the opposite surface. In this configuration, second fastening part 420*a* may be joined with first fastening part 410 such that indicia 340*a* faces outward. First fastening part 410 and second fastening part 420 act cooperatively to releasably-attach secondary portions 300 to primary portion 200. In the preferred embodiment, first fastening part 410 and A second fastening part 420 are formed of opposite portions of a hook and loop fastener, such as VELCRO. However, in further embodiments, other fasteners that permit a releasable-attachment may be used, including snaps, buttons, pins, and magnets.

Figure 4A:
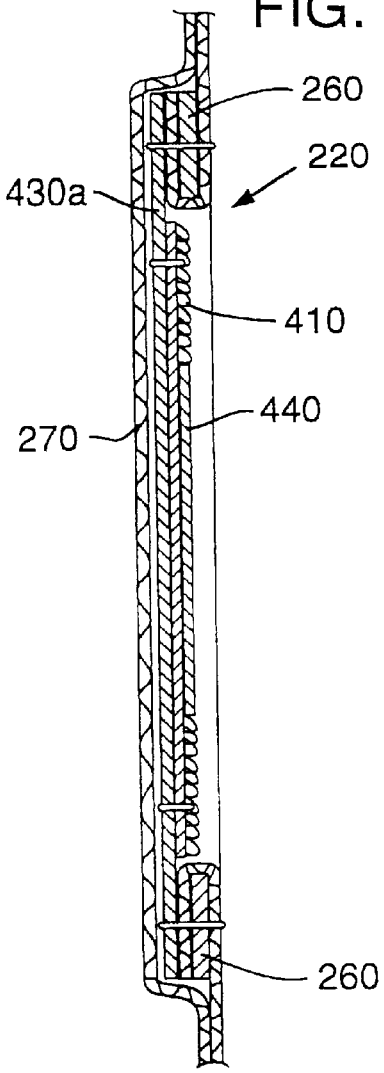
FIG. 4A is a cross-section along line 4—4 of FIG. 3 depicting a first primary embodiment.

FIG. 4A is a cross-section, as defined in FIG. 3, that depicts a first primary embodiment of the present invention. First fastening part 410 is located entirely within aperture 220 and is secured to connecting element 430*a*, a thin member formed of plastic, cloth, or other suitable material which is stitched to primary portion 200. Although first fastening part 410 may extend throughout the entire area comprising aperture 220, a sufficient attachment with secondary fastening part 420 is achieved if first fastening part 410 is located adjacent to the edges that form aperture 220, thereby defining interior region 440. In the preferred embodiment, interior region 440 contains permanently-attached interior indicia 450. Located on the interior of primary portion 200 is liner 270. The purpose of liner 270 is to improve comfort and conceal connecting element 430*a* and the seams that join connecting element 430*a* with primary portion 200. In alternate embodiments, interior region 440 may contain no indicia or have a second aperture defined therethrough. In one technique for forming aperture 220, the material comprising panels 210 is folded toward the interior of apparel 100 and around frame 260. Frame 260 is a semi-rigid element that surrounds and provides support to aperture 220.

Figure 4B:
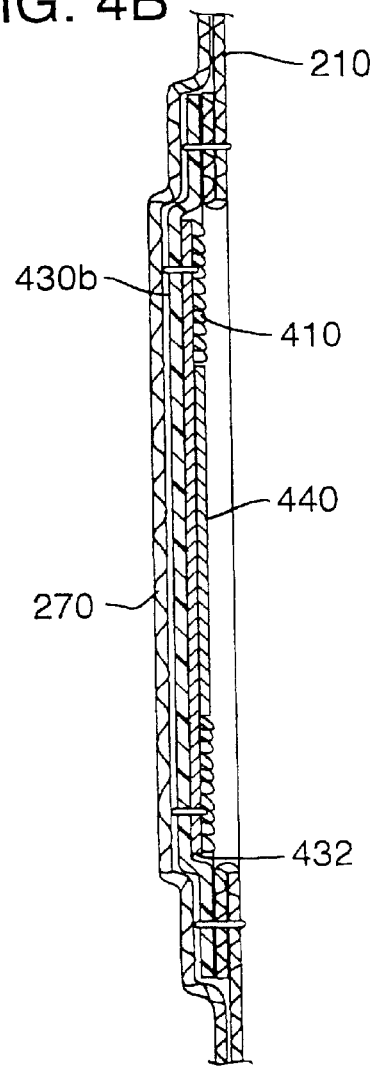
FIG. 4B is a cross-section along line 4—4 of FIG. 3 depicting a second primary embodiment.
Figure 5A:
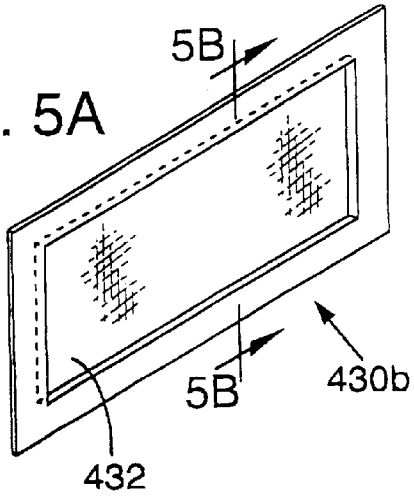
FIG. 5A is a perspective view of the connecting element of the second primary embodiment.
Figure 5B:
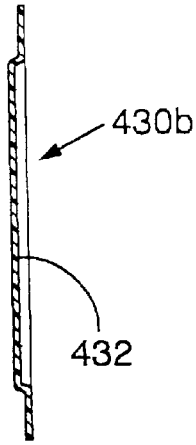
FIG. 5B is a cross-section along line 5B—5B of FIG. 5A.

In a second primary embodiment of the present invention, connecting element 430*a* is replaced with connecting element 430*b*. Rather than having a flat configuration, connecting element 430*b*, depicted in FIGS. 5, includes indentation 432 that approximately corresponds in width and height to aperture 220. Referring to FIG. 4B, a cross-section along line 4—4 of FIG. 3, first fastening part 410 is attached within indentation 432 using either a permanent adhesive or conventional sewing technique. As with the prior embodiment, first fastening part 410 may be located near the perimeter of aperture 220, thereby being located near the perimeter of indentation 432, with interior region 440 and interior indicia 450 located in central portions of indentation 432. The primary advantage of this embodiment is that the depth of indentation 430*b*, preferably 2 millimeters, combined with the depth of primary portion 200 in the area of aperture 220, is such that display side 330 is flush with the exterior region of primary portion 200. Unlike the first primary embodiment, wherein frame 260 is used for purposes of support, connecting element 430*b*, preferably formed of a semi-rigid polymer, provides sufficient support to the area of aperture 220. Accordingly, this configuration reduces the number of elements and the difficulty of manufacturing apparel 100, thereby decreasing overall cost.

To facilitate storage of secondary portions 300 that are not attached to first fastening part 410, a plurality of third fastening parts 460, formed of the same material that forms first fastening part 410, may be attached to the interior of primary portion 200, as illustrated in FIG. 6. To store unused secondary portions 300, the wearer may attach second fastening part 420 to one of third fastening parts 460*a*–460*d*. To increase wearer comfort, third fastening part 460 is located behind flap 280. This configuration ensures that the body of the wearer does not directly contact areas of third fastening part 460 or secondary portions 300 attached thereto.

This invention has been disclosed with reference to the preferred embodiments. These embodiments, however, are merely for example only and the invention is not restricted thereto. It will be understood by those skilled in the art that other variations and modifications can easily be made within the scope of this invention as defined by the appended claims.

That which is claimed is:

1. A baseball-style cap comprising:

a primary portion configured to define an aperture;

a secondary portion having dimensions approximately corresponding to dimensions of said aperture, said secondary portion having a fastening side and a display side located opposite to said fastening side; and a fastening system for releasably-attaching said secondary portion to said primary portion, said fastening system including a first fastening part and a second fastening part, said first fastening part being secured to and located entirely within said aperture, and said second fastening part being attached to said fastening side of said secondary portion.

2. The article of apparel of claim 1, wherein said display side includes indicia.

3. The article of apparel of claim 2, including more than one said secondary portion, each said secondary portion having a different indicia.

4. The article of apparel of claim 1, wherein said first and second fastening parts are portions of a hook and loop fastener.

5. The article of apparel of claim 4, wherein an area comprising said first fastening part encompasses an area less than said aperture.

6. The article of apparel of claim 4, wherein said first fastening part is located adjacent to the edge of said aperture and extends around an interior region, said interior region including indicia.

7. The article of apparel of claim 1, wherein said first fastening part is attached to a connecting element, said connecting element being attached to said primary portion.

8. The article of apparel of claim 7, wherein said connecting element is attached to an interior area of said primary portion, said interior area being adjacent to both the aperture and the body of a wearer.

9. The article of apparel of claim 8, wherein said connecting element is formed separate from said first fastening part.

10. The article of apparel of claim 9, wherein said connecting element has an indentation defined therein, said indentation being located behind said aperture.

11. The article of apparel of claim 10, wherein said first fastening part is located within said indentation.

12. A baseball-style cap comprising:

a primary portion formed of a plurality of panels and configured to define an aperture;

a secondary portion having dimensions approximately corresponding to dimensions of said aperture and having a fastening side and a display side; and a fastening system comprised of:

a first fastening part located entirely within said aperture and attached to a connecting element, said connecting element attached to an interior surface of said primary portion, said interior surface being adjacent to both the aperture and a body of a wearer; and a second fastening part located on said fastening side and releasably-attaching to said first fastening part, thereby releasably-attaching said secondary portion to said primary portion.

13. The baseball-style cap of claim 12, wherein said aperture is located in the brow region of said cap, said brow region covering a forehead of a wearer.

14. The baseball-style cap of claim 12, wherein said connecting element is formed separate from said first fastening part.

15. The baseball-style cap of claim 12, wherein said display side includes indicia.

16. The baseball-style cap of claim 15, including more than one said secondary portion, each said secondary portion having a different indicia.

17. The baseball-style cap of claim 16, wherein a third fastening part is located on an interior area of said apparel, said third fastening part releasably-attaching to said second fastening part and facilitating storage of said secondary portions that are not attached to said first fastening part.

18. The baseball-style cap of claim 12, wherein said fastening system is a hook and loop fastening system.

19. The baseball-style cap of claim 18, wherein an area comprising said first fastening part encompasses an area less than said aperture.

20. The baseball-style cap of claim 18, wherein said first fastening part is located adjacent to the edge of said aperture and extends around an interior region, said interior region including indicia.

21. The baseball-style cap of claim 12, wherein said aperture is defined by edges of said panels.

22. An article of apparel comprising:

a primary portion configured to define an aperture;

a plurality of secondary portions having dimensions approximately corresponding to dimensions of said aperture, said secondary portions each having a fastening side and a display side located opposite to said fastening side, said display side including indicia; and a fastening system for releasably-attaching one of said secondary portions to said primary portion, said fastening system including a first fastening part and a second fastening part, said first fastening part being secured to and located entirely within said aperture, and said second fastening part being attached to said fastening side of said secondary portion, and said fastening system including a third fastening part located on an interior surface of said primary portion, said third fastening part releasably-attaching to said second fastening parts and facilitating storage of said secondary portions that are not attached to said first fastening part.

23. The article of apparel of claim 22, wherein said fastening parts are portions of a hook and loop fastener.

24. The article of apparel of claim 22, wherein said article is a baseball-style cap.

25. The article of apparel of claim 24, wherein said third fastening part is located behind a flap, said flap being attached to a lower rim of said primary portion.

26. A baseball-style cap comprising:

a primary portion configured to define an aperture, said primary portion including a plurality of panels, said aperture being defined by edges of said panels;

a secondary portion having dimensions approximately corresponding to dimensions of said aperture, said secondary portion having a fasting side and a display side located opposite to said fastening side; and a fastening system for releasably-attaching said secondary portion to said primary portion, said fastening system including a first fastening part and a second fastening part, said first fastening part being secured to and located entirely within said aperture, and said second fastening part being attached to said fastening side of said secondary portion.

27. The article of apparel of claim 26, wherein said display side includes indicia.

28. The article of apparel of claim 27, including more than one said secondary portion, each said secondary portion having a different indicia.

29. The article of apparel of claim 26, wherein said first and second fastening parts are portions of a hook and loop fastener.

30. A baseball-style cap comprising:

a primary portion formed of a plurality of panels and configured to define an aperture;

a secondary portion having dimensions approximately corresponding to dimensions of said aperture and having a fastening side and a display side; and a fastening system comprised of:

a first fastening part located entirely within said aperture and attached to a connecting element, said connecting element being attached to an interior surface of said primary portion, said interior surface being adjacent to both the aperture and a body of a wearer, said connecting element having an indentation defined therein, said indentation being located behind said aperture; and a second fastening part located on said fastening side and releasably-attaching to said first fastening part, thereby releasably-attaching said secondary portion to said primary portion.

31. The baseball-style cap of claim 30, wherein said first fastening part is located within said indentation.

32. The baseball-style cap of claim 30, wherein said display side of said secondary portion is flush with the exterior of said primary portion when said secondary portion is secured within said aperture.

33. A baseball-style cap comprising:

a primary portion configured to define an aperture;

a secondary portion having dimensions approximately corresponding to dimensions of said aperture, said secondary portion having a fastening side and a display side located opposite to said fastening side; and a fastening system for releasably-attaching said secondary portion to said primary portion, said fastening system including a first fastening part and a second fastening part, said first fastening part being secured to and located entirely within said aperture, and said second fastening part being attached to said fastening side of said secondary portion, wherein said display side of said secondary portion is flush with an exterior of said primary portion when said secondary portion is secured within said aperture.

34. The baseball-style cap of claim 33, wherein said display side includes indicia.

35. The baseball-style cap of claim 34, including more than one said secondary portion, each said secondary portion having a different indicia.

36. The baseball-style cap of claim 33, wherein a third fastening part is located on an interior surface of said primary portion and behind a flap, said flap being attached to a lower rim of said primary portion, said third fastening part releasably-attaching to said second fastening part and facilitating storage of said secondary portions that are not attached to said first fastening part.

37. The baseball-style cap of claim 33, wherein said first and second fastening parts are portions of a hook and loop fastener.

38. The baseball-style cap of claim 37, wherein an area comprising said first fastening part encompasses an area less than said aperture.

39. The baseball-style cap of claim 37, wherein said first fastening part is located adjacent to the edge of said aperture and extends around an interior region, said interior region including indicia.

40. The baseball-style cap of claim 33, wherein said first fastening part is attached to a connecting element, said connecting element being attached to said primary portion.

41. The baseball-style cap of claim 40, wherein said connecting element is attached to an interior area of said primary portion, said interior area being adjacent to both the aperture and the body of a wearer.

42. The baseball-style cap of claim 41, wherein said connecting element is formed separate from said first fastening part.

43. The baseball-style cap of claim 42, wherein said connecting element has an indentation defined therein, said indentation being located behind said aperture.

44. The baseball-style cap of claim 43, wherein said first fastening part is located within said indentation.

* * * * *